US005644807A

United States Patent [19]

Battistella

[11] Patent Number: 5,644,807

[45] Date of Patent: Jul. 8, 1997

[54] BEACH TOWEL WITH DETACHABLE PILLOW AND CARRYING CASE HAVING POCKETS

[76] Inventor: Dawn A. Battistella, 3723 Delaware Ave., Kenner, La. 70065

[21] Appl. No.: 705,283

[22] Filed: Aug. 29, 1996

[51] Int. Cl.[6] ..... A47G 9/06; A47G 9/00

[52] U.S. Cl. ..... 5/419; 5/417; 5/639; 5/485; 5/922; 5/644

[58] Field of Search ..... 5/419, 417, 418, 5/420, 636, 644, 490, 485, 922, 413 R, 639; 383/4, 38; 190/1, 2; 150/154

[56] References Cited

U.S. PATENT DOCUMENTS

| | | | |
|---|---|---|---|
| 1,704,182 | 3/1929 | Ellery | 5/413 R |
| 4,154,323 | 5/1979 | Sneider | 5/417 |
| 4,601,076 | 7/1986 | Knobeloch | 5/420 |
| 4,980,935 | 1/1991 | Kazanowski et al. | 5/419 |
| 5,056,533 | 10/1991 | Solano | 5/922 |
| 5,110,219 | 5/1992 | Lopes | 5/419 |
| 5,163,192 | 11/1992 | Watson | 5/419 |
| 5,345,627 | 9/1994 | Cammarata | 5/419 |
| 5,467,487 | 11/1995 | Sicard | 5/419 |

FOREIGN PATENT DOCUMENTS

| | | | |
|---|---|---|---|
| 60744 | 4/1939 | Norway | 5/413 R |

*Primary Examiner*—Alexander Grosz
*Attorney, Agent, or Firm*—Patent & Trademark Services; Joseph H. McGlynn

[57] ABSTRACT

A Beach Towel With Pillow comprising a beach towel of highly absorbent fabric with an inflatable pillow attached to the towel by means of a hook and loop type fastener, which allows for ease of attaching and detaching. The inflatable pillow may be manufactured of vinyl with welded seams which prevent air leakage after inflation and a velvet-like flocking material may be applied to give the vinyl a cloth-like feel. One edge of the pillow is provided with a series of storage compartments for small items to be carried, the small storage compartments being fastened by means of a hook and loop type fastener. The Beach Towel With Pillow may be rolled up and bound by the binding cords attached to one lateral edge of the beach towel.

4 Claims, 1 Drawing Sheet

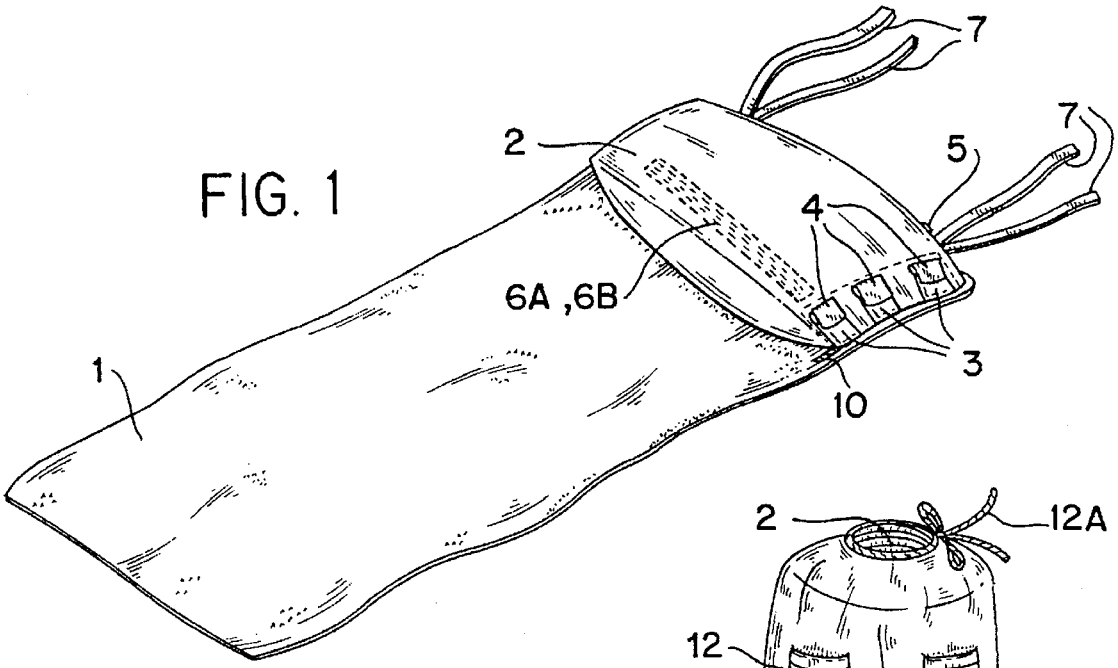
FIG. 1
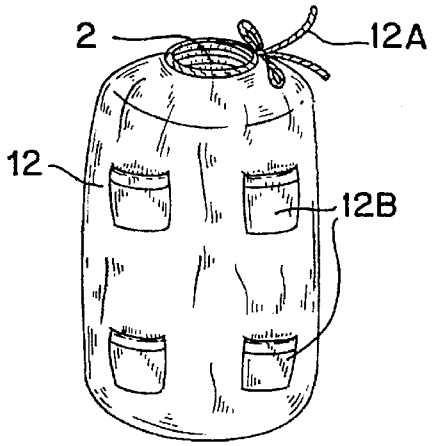
FIG. 4
FIG. 2
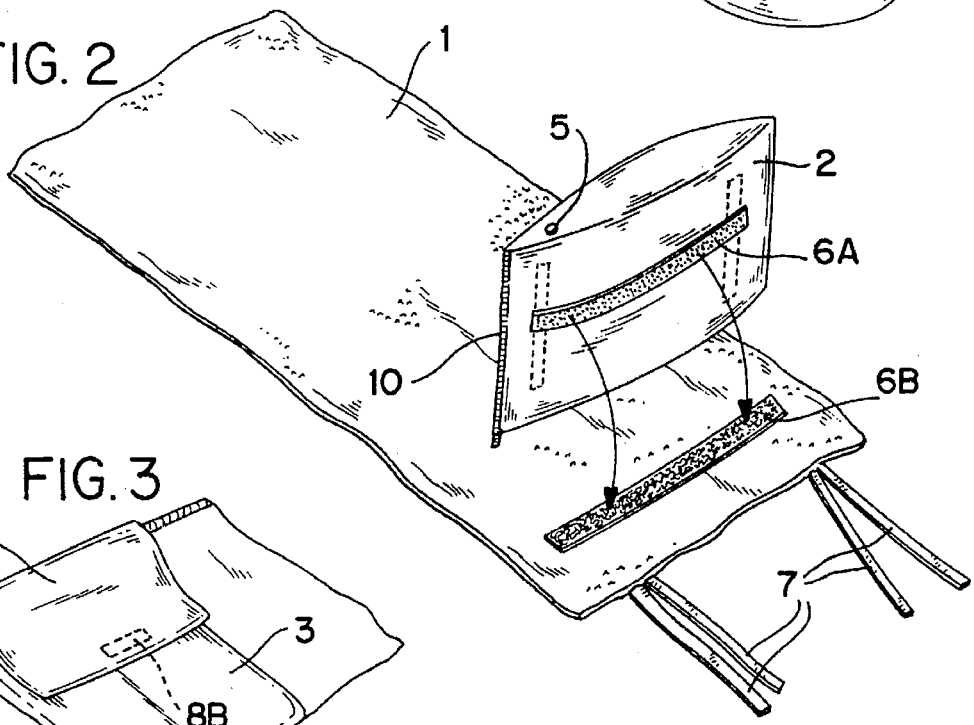
FIG. 3
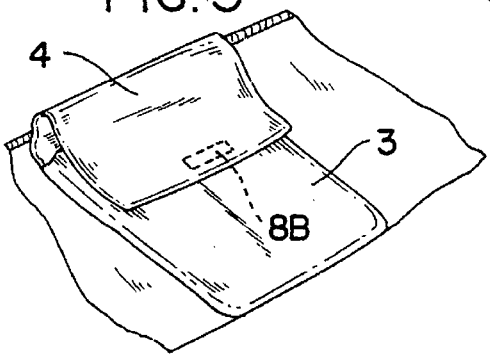

BEACH TOWEL WITH DETACHABLE PILLOW AND CARRYING CASE HAVING POCKETS

BACKGROUND OF THE INVENTION

This invention relates, in general, to a towel with a detachable inflatable pillow and, in particular, to a beach towel with a detachable inflatable pillow and an optional carrying case.

The instant invention would replace the old standard beach towel with the Beach Towel With Pillow when a user is at the beach, sunning, or picnicking. Everything necessary for a day in the sun can be conveniently carried in an all-in-one carrier, towel and pillow. The user merely places suntan lotion, sunglasses, reading material, etc. into the small pockets on the deflated pillow, rolls up the towel like a bedroll and ties the roll to keep it together. None of the small items will fall out of the towel roll because the pockets are fastened with a Velcro® type hook and loop type fastener.

The scope of the invention should not be limited specifically to a beach towel: the Beach Towel With Pillow may be used anywhere an individual may go to lie down.

DESCRIPTION OF THE PRIOR ART

In the prior art various types of beach towels have been proposed. For example, U.S. Pat. No. 4,980,935 shows a beach towel with an open ended receptacle at one end which contains a pillow. One end of the receptacle is attached to a carrying bag.

U.S. Pat. No. 5,163,192 shows a sun bathing mat with one end rolling over itself and attaching to the main body of the mat with ties that create an enclosed space into which a head rest may be placed.

U.S. Pat. No. 5,345,627 discloses a beach towel with a terry cloth covered foam pillow. A terry cloth flap covers a securing means by which the pillow is releasably attached to the towel.

U. S. Pat. No. 5,467,487 shows a beach towel which may be rolled and carried by carry handles. One end of the towel contains an opening that may function as a duffel bag and encases an inflatable pillow. The opening is also provided with storage space for miscellaneous necessary items.

SUMMARY OF THE INVENTION

The design of the Beach Towel With Pillow is that of a beach towel with an inflatable pillow attached to the towel by means of a hook and loop type fastener. The towel itself is manufactured of a highly absorbent cotton blend or terry cloth, with one portion of the hook and loop type fastener securely attached to the towel. The inflatable pillow may be shaped similarly to that of a standard bed pillow and may be manufactured of vinyl with welded seams which prevent air leakage after inflation, with a capped air inflation nozzle being provided to be used for forcing air into the pillow. During the manufacturing process, the vinyl of the pillow may be coated with an optional velvet-like flocking material to give the pillow a cloth-like feel. As an option, the pillow can be covered with a terry cloth like material which is similar to the material used for towels. One edge of the pillow is provided with a series of storage compartments for small items to be carried and the second portion of the hook and loop fastener is securely connected to the back of the pillow. The hook and loop fastener allows for easy attaching of the pillow after inflation and detaching of the pillow when it is desired to deflate and store the pillow. The pillow case should have a zipper at one end for easy removal of the deflated pillow, in order to wash the pillow case.

Two sets of binding cords are provided on one end of the towel so that the towel may be tied together for securing the towel in a bedroll type manner.

Prior to use of the Beach Towel With Pillow, the user would load the smaller pouches on the pillow portion with items, the pillow being in the deflated condition. A swimsuit or other clothing item could also be placed into the center of the towel and the towel then rolled up and tied together with the two sets of strings.

When it is desired to use the Beach Towel With Pillow, the user would merely untie and unroll the Beach Towel with Pillow, inflate the pillow and attach the pillow to the towel by means of the hook and loop type fastener. Small storage compartments along the edge of the pillow are readily accessible as needed.

These and other objects and advantages of the present invention will be fully apparent from the following description, when taken in combination with the annexed drawings.

BRIEF DESCRIPTION OF THE DRAWINGS

FIG. 1 is a top view of the Beach Towel With Pillow showing the pillow in the inflated and attached condition.

FIG. 2 is a top view of the Beach Towel With Pillow showing the inflation nozzle and the means of attaching the inflatable pillow to the towel.

FIG. 3 is a view of one of the storage compartments on the Beach Towel With Pillow.

FIG. 4 is a view of the carrying case.

DESCRIPTION OF THE PREFERRED EMBODIMENTS

Referring now to the drawings in greater detail, FIG. 1, shows a full front view of the beach towel 1 with the inflatable pillow 2 in the inflated condition and being releasably attached to the beach towel 1. A number of pockets 3 are provided along the shorter edge of the inflatable pillow 2, the pockets 3 being provided with flaps 4 for closing each of the pockets 3. The flaps 4 are closed by means of the two-part hook and loop fasteners **8*b* as shown enlarged in FIG. 3**.

The inflatable pillow 2 is further provided with an inflation nozzle 5 through which air may be forced to inflate the pillow 2. The means of inflation may be a tube into which a user may blow air similar to the nozzle on a beach ball, or it could take the form of a tire valve used to inflate bicycle tires.

Two sets of binding cords 7 are further provided for use in tying the beach towel 1 when it is in the rolled up condition. The cords can be made unitary with the beach towel or they could be attached later such as, but not limited to, by sewing the cords to the towel, or by attaching them by an adhesive.

FIG. 2 shows the beach towel 1 with the inflatable pillow 2 in its inflated condition with the inflatable pillow 2 being detached from the beach towel 1 and illustrating the two-part hook and loop fasteners 6A and 6B located on the back side of the pillow 2. At the top of the pillow 2 can be seen the inflation valve 5. It should be noted that this location is merely for illustration purposes, and other locations may be selected for the inflation valve without departing from the scope of the present invention. Also, a pillow case can be used to cover the pillow and secured with a zipper 10 or some other form of fastener. The pillow case could include an aperture for the valve to protrude outside the case, or the valve could remain within the pillow case and the case removed whenever the valve has to be used. In addition the Velcro® hook and loop fasteners 6A, 6B could be attached to the pillow case instead of directly to the pillow. Also, the pockets 3 could be attached to the pillow case instead of directly to the pillow 2.

FIG. 3 is a partial view of the beach towel 1 illustrating one of the pockets 3 with the foldover flap 4 being in the closed position. A two-part hook and loop fastener 8B is used to maintain the flap in its closed position when desired and to allow for ease of opening, as needed.

As shown in FIGS. 1 and 2, attached to one end of the beach towel 1 is an inflatable pillow 2. The inflatable pillow 2 is preferably manufactured using an electronically heat welded vinyl process. Vinyl may be die cut and heat welded together. The "die cutting" of the sheet vinyl is a process which cuts vinyl into a specific shape through the use of steel ruled dies. Steel ruled dies are flat, sharpened pieces of steel which resemble a hacksaw blade. The dies are bent into the desired shape and held in place by channels cut out into a thick sheet of wood. In operation, the sharpened edges of the die are brought into face to face contact with a flat piece of vinyl. The die is pressed against the vinyl sheet, cutting it to the shape of the inflatable pillow 2. At the time of manufacture, a flocking type of material may be added to the vinyl to give the inflatable pillow 2 a cloth or carpet like feel. Of course, other materials and methods could be used to make and attach the inflatable pillow 2 to the beach towel 1 without departing from the scope of the present invention.

FIG. 4 shows a carrying case 12 which can be used to carry the towel 1, in its rolled up condition, and the inflatable pillow 2. The case 12 can be provided with a plurality of pockets 12B which can be used to carry items such as, but not limited to, car keys. Also, the case 12 can be provided with a drawstring 12A to close the top of the carry case 12.

Although the Beach Towel With Pillow and the method of using the same according to the present invention has been described in the foregoing specification with considerable detail, it is to be understood that modifications may be made to the invention which do not exceed the scope of the appended claims and modified forms of the present invention by others skilled in the art to which the invention pertains will be considered infringements of this invention when those modified forms fall within the claimed scope of this invention.

What I claim as my invention is:

1. A beach towel with pillow and carrying case comprising:

an elongated piece of fabric having two laterally extending edges and two longitudinally extending edges;

an elongated, inflatable pillow, said inflatable pillow being provided with a plurality of pouches, said pouches being attached to at least one side of said inflatable pillow, and said pouches having flaps which close said pouches;

means for detachably connecting said inflatable pillow to said fabric, said inflatable pillow being attachably disposed along one of said lateral edges said inflatable pillow having an inflation nozzle thereon;

one lateral edge of said beach towel being provided with means for securing said fabric in a rolled up condition and a carrying case for holding said towel and pillow, said carrying case having an open top, said open top having a draw string attached thereto for closing said open top, and an outside surface of said carrying case having a plurality of pockets disposed thereon.

2. The beach towel with pillow as defined in claim 1, wherein each of said pouches is closed by means of mating hook and loop type fasteners.

3. The beach towel with pillow as defined in claim 1, wherein said inflatable pillow is made from a heavy-duty waterproof vinyl material, said vinyl material has a flocking material applied to at least one outer surface thereof.

4. The beach towel with pillow as defined in claim 1, wherein said means for securing said fabric in a rolled up condition is at least a pair of flexible cords disposed on one lateral edge of said fabric.

* * * * *